US005836259A

United States Patent [19]

Tanaka

[11] Patent Number: 5,836,259

[45] Date of Patent: Nov. 17, 1998

[54] EMBROIDERY SEWING MACHINE

[75] Inventor: Takafumi Tanaka, Nagoya, Japan

[73] Assignee: Brother Kogyo Kabushiki Kaisha, Nagoya, Japan

[21] Appl. No.: 972,048

[22] Filed: Nov. 17, 1997

[30] Foreign Application Priority Data

Nov. 19, 1996 [JP] Japan ..... 8-308510

[51] Int. Cl.[6] ..... D05B 21/00

[52] U.S. Cl. ..... 112/102.5; 112/445; 364/470.09

[58] Field of Search ..... 112/102.5, 470.01, 112/470.04, 470.06, 445, 454, 456, 458; 364/470.09, 470.07, 470.08

[56] References Cited

FOREIGN PATENT DOCUMENTS

A-4-30892 2/1992 Japan .
A-4-319386 11/1992 Japan .
A-7-24161 1/1995 Japan .
A-7-116365 5/1995 Japan .
7-155487 6/1995 Japan .

*Primary Examiner*—Peter Nerbun
*Attorney, Agent, or Firm*—Oliff & Berridge, PLC

[57] ABSTRACT

An embroidery sewing machine performs an embroidery forming operation on a workpiece cloth based on pattern data including data of partial patterns obtained by dividing an embroidery pattern into one or more partial patterns and data of thread colors representing colors of embroidery threads corresponding to the respective partial patterns. The machine includes a display device mounted on the machine main body. The display device is controlled to separately display an embroidery pattern display screen for displaying the partial patterns and a thread color display screen for displaying thread colors corresponding to the respective partial patterns. The display device is switched between the embroidery pattern display screen and the thread color display screen.

17 Claims, 8 Drawing Sheets

C
24
COLOR CHANGE
SEWING SETTING
L
S
PATTERN
E
F
1/ 3
THREAD COLOR
D1
D2
D3
B
THREAD COLOR
COLOR CHANGE

WHITE
RED
BLACK
G
G
G

1/ 1
D

COLOR FREE
H

EMBROIDERY SEWING MACHINE

BACKGROUND OF THE INVENTION

1. Field of the Invention

This invention relates to an embroidery sewing machine capable of sewing a multicolored embroidery on a workpiece cloth.

2. Description of the Prior Art

There has recently been provided a household embroidery sewing machine capable of sewing an embroidery of a relatively complicated large picture pattern on a workpiece cloth using a plurality of embroidery threads of different colors. This manner of sewing will hereinafter be referred to as "multicolor sewing." The embroidery sewing machine sews the embroidery based on embroidery data stored in an internal memory provided in the machine or an external memory medium such as a memory card. The embroidery data for the multicolor sewing is composed of data of different partial patterns obtained by dividing an embroidery pattern into one or more different partial patterns and thread color data representing colors (recommended colors) of embroidery threads corresponding to the respective partial patterns.

The above-described embroidery sewing machine is provided with a display device, such as a liquid crystal display (LCD) 1 (see FIG. 8) mounted on a front surface of the main body (arm portion) thereof. Upon selection of an embroidery pattern for the multicolor sewing, the display device is controlled to inform the user what partial patterns the embroidery pattern is composed of and what colors of embroidery thread should be used for the respective partial patterns. For these purposes, the display device is designed to display the partial patterns, and the names of colors corresponding to the respective partial patterns. More specifically, when the user selects an embroidery pattern of "tulip" as shown in FIG. 8, for example, the LCD 1 displays on its screen the overall embroidery pattern A1, an embroidering order A2, partial patterns A3, and embroidery thread colors A4 for the respective partial patterns. In this case, the partial patterns A3 include a portion of stalk and blades, a portion of flowers, and a contour. The embroidery sewing machines of the above-described type are disclosed in Japanese patent publication Nos. 4-319386, 7-116365, and 7-155487.

In the above-described embroidery sewing machine, however, both of the partial patterns A3 and the embroidery thread colors A4 are displayed together on a single screen of the LCD 1. Accordingly, an area of the screen which can be allotted to each displayed element is reduced. This results in inconvenience to the user when he or she views the screen. Particularly in recent years, the prior art has provided embroidery sewing machines capable of sewing more complicated large-sized embroidery patterns and formed with a touch panel on the surface of the LCD 1 so that an operation key section is provided on a part of the screen. Consequently, a space on the LCD 1 used for displaying each partial pattern tends to be further reduced. Provision of a large-sized LCD could be considered. However, this increases the cost of the embroidery sewing machine as well as the size of the overall machine main body. Additionally, color liquid crystal displays have been proposed which display the thread colors not in characters but in actual colors. However, this also increases the cost of the embroidery sewing machines.

SUMMARY OF THE INVENTION

Therefore, an object of the present invention is to provide an embroidery sewing machine which is capable of sewing multicolor embroideries and in which the partial patterns of an embroidery pattern and thread colors of the respective partial patterns can be displayed in such a manner that the user can clearly recognize them, with the display device being prevented from being rendered large-sized.

The present invention provides an embroidery sewing machine comprising an embroidery forming apparatus for forming an embroidery on a workpiece cloth based on pattern data including data of different partial patterns obtained by dividing an embroidery pattern into one or more different partial patterns and data of thread colors representing colors of embroidery threads corresponding to the respective partial patterns, and a machine main body. A display device is provided on the machine main body. Display control means is provided for controlling the display device so that the display device separately displays an embroidery pattern display screen for displaying each partial pattern and a thread color display screen for displaying a thread color corresponding to each partial pattern, based on the pattern data. Display switching operation means is operated for switching the display on the display device between the embroidery pattern display screen and the thread color display screen.

According to the above-described embroidery sewing machine, the display control means controls the display device so that each partial patterns are displayed on the embroidery pattern display screen and the thread colors corresponding to the respective partial patterns are displayed on the thread color display screen. Thus, the partial patterns and the thread colors are separately displayed on the respective screens. Consequently, a display region for each piece of information can be increased as compared with the case where both pieces of information are simultaneously displayed on a single screen. Furthermore, the embroidery pattern display screen and the thread color display screen can be switched therebetween when the user operates the display switching operation means. As a result, the information the user wishes to view can readily be displayed on the display device.

The display device preferably comprises a monochrome liquid crystal display (LCD). Furthermore, the display control means preferably controls the display device so that a total number of the partial patterns is displayed on each of the embroidery pattern display and thread color display screens. It is further preferable that the display control means controls the display device so that the display device displays an order of the currently sewn partial pattern in a sequence of the partial patterns during execution of an embroidery forming operation.

The embroidery sewing machine preferably further comprises mode switching operation means operated for switching a sewing mode between a multicolor sewing mode in which the partial patterns are embroidered with threads of different colors respectively and a single color sewing mode in which all the partial patterns are embroidered with a thread of a single color. In this arrangement, the sewing mode can be switched from the multicolor sewing mode to the single color sewing mode upon operation of the mode switching operation means when an embroidery pattern for the multicolor sewing is desired to be sewn in the single color mode. Consequently, since a color changing operation of the machine and a color changing work by the user are thus eliminated, the embroidery forming operation can efficiently be performed. When the sewing mode has been switched to the single color sewing mode, the display control means preferably controls the display device so that the display device displays, on the embroidery pattern display screen, a pattern formed by compositing all the partial patterns, and so that the display device displays, on the thread color display screen, to an effect that a user can freely select a thread color. Furthermore, the display switching operation means or the mode switching operation means preferably comprises a touch panel provided on a screen of the display device.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENT

Figures 5A, 5B, 5C, 5D:
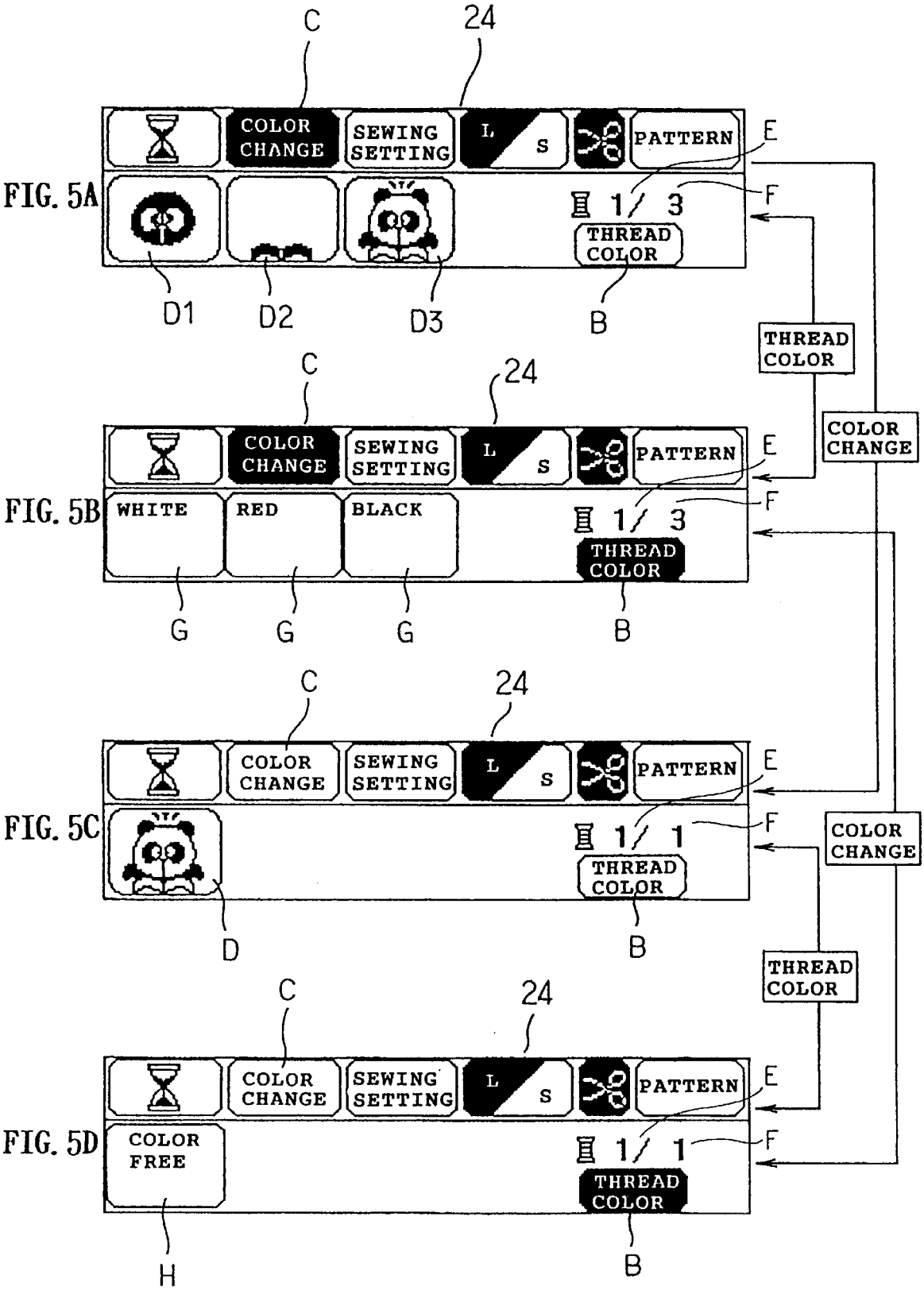
FIGS. 5A to 5D illustrate screens of the display device.
Figure 6:
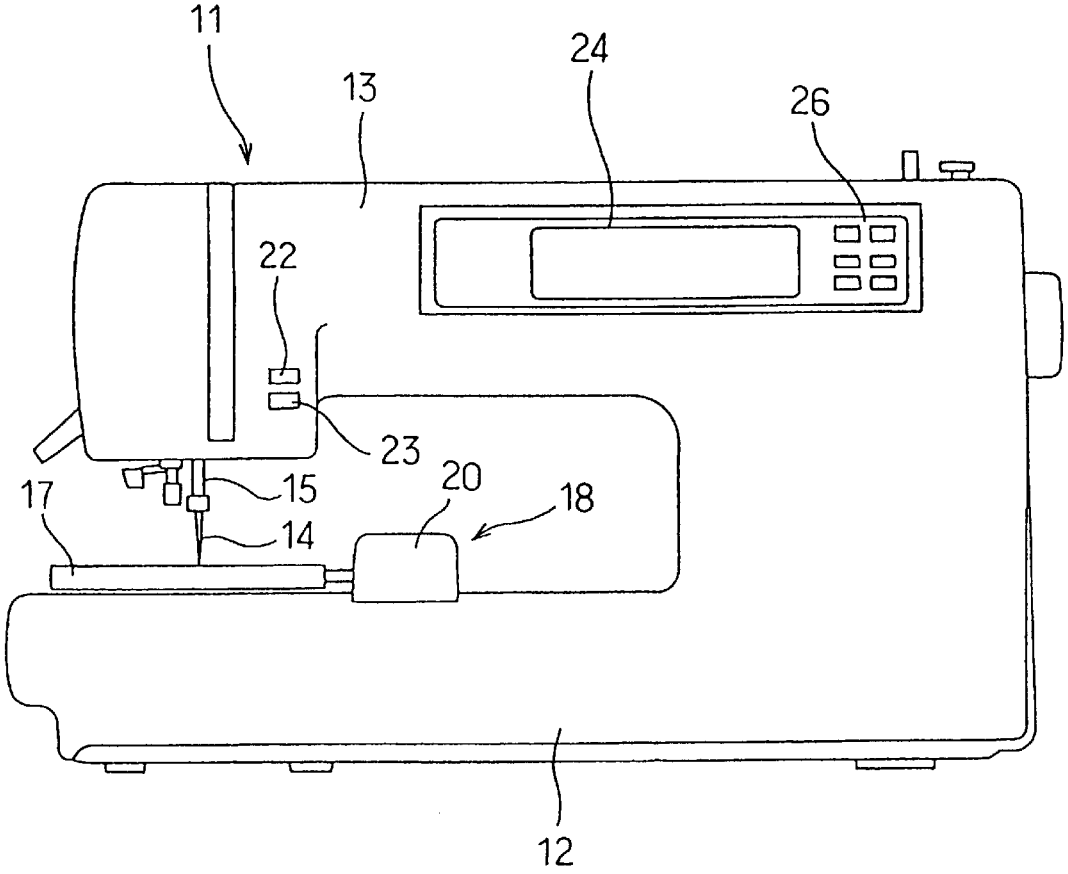
FIG. 6 is a front view of the main body of the embroidery sewing machine.

An embodiment in accordance with the present invention will be described with reference to FIGS. 1 to 7. The invention is applied to a household embroidery sewing machine in the embodiment. Referring first to FIG. 6, the embroidery sewing machine of the embodiment is schematically shown. A main body 11 of the embroidery sewing machine comprises a bed 12 and an arm 13 formed integrally with the bed 12. A distal end of the arm 13 is provided with a needle bar 15 having a sewing needle 14. A throat plate (not shown) is mounted on an upper surface of the bed 12 so as to correspond to the needle bar 15. A shuttle mechanism (not shown) is provided at a position under the throat plate. The needle bar 5, shuttle mechanism, etc. are synchronously driven via a drive mechanism (not shown) by a main motor 16 (see FIG. 7) so that a sewing operation is executed.

An embroidery frame 17 for holding a workpiece cloth (not shown) is disposed on the upper surface of the bed 12. An embroidery frame moving mechanism 18 is also provided on the upper surface of the bed 12 for moving the embroidery frame 17 and accordingly the workpiece cloth freely horizontally, that is, frontward and rearward, and leftward and rightward. The embroidery frame 17 includes an outer frame and an inner frame between which the workpiece cloth is sandwiched, so that the workpiece cloth can be held tightly stretched inside the embroidery frame 17 between the frame and the throat plate. The embroidery frame moving mechanism 18 comprises a movable member 20 moved by an X-axis pulse motor 21 (shown only in FIG. 7) freely in the X-axis direction, that is, leftward and rightward as viewed in FIG. 6. The moving mechanism 18 further comprises another movable member (not shown) provided in the movable member 20 to be moved by a Y-axis pulse motor 19 (shown only in FIG. 7) freely in the Y-axis direction, that is, frontward and rearward. The embroidery frame 17 is detachably attached to the movable member provided in the movable member 20. Consequently, the workpiece cloth held by the embroidery frame 17 can be moved by the embroidery frame moving mechanism 18 to an optional position based on an intrinsic X-Y coordinate system.

An embroidering operation is performed when the needle bar 15, shuttle mechanism, etc. are driven by the drive mechanism while the workpiece cloth is moved freely relative to the needle bar 15 by the embroidery moving mechanism 18. The needle bar 15, shuttle mechanism, drive mechanisms for the needle bar 15 and shuttle mechanism, embroidery frame 17, embroidery frame moving mechanism 18, etc. constitute an embroidery forming apparatus in the present invention. A start/stop key 22 and a needle lifting key 23 are provided on a front surface of the distal end of the arm 13.

A display device 24 is provided on the front surface of the arm 13 for displaying on its screen a variety of embroidery patterns and messages. The display device 24 comprises a monochrome liquid crystal display (LCD) of a relatively small size type disposed to extend horizontally along the arm 13, as shown in FIG. 6. The display device 24 displays a pattern type selection screen for selecting a desired embroidery pattern, an embroidery pattern display screen (see FIGS. 5A and 5C), as will be described in detail later, and a thread color display screen (see FIGS. 5B and 5D), as will be described in detail later when an embroidery forming operation is to be executed. A touch panel 25 (shown only in FIG. 7) is provided on the surface of the display device 24. The touch panel 17 includes various operation keys as well known in the art. The touch panel 25 comprises a number of transparent electrodes arranged vertically and horizontally and detects where the user touches it, as well known in the art. Various keys 26 for instructing to call data of embroidery patterns and for other purposes are provided at the right of the display device 24 on the front surface of the arm 13.

Figure 7:
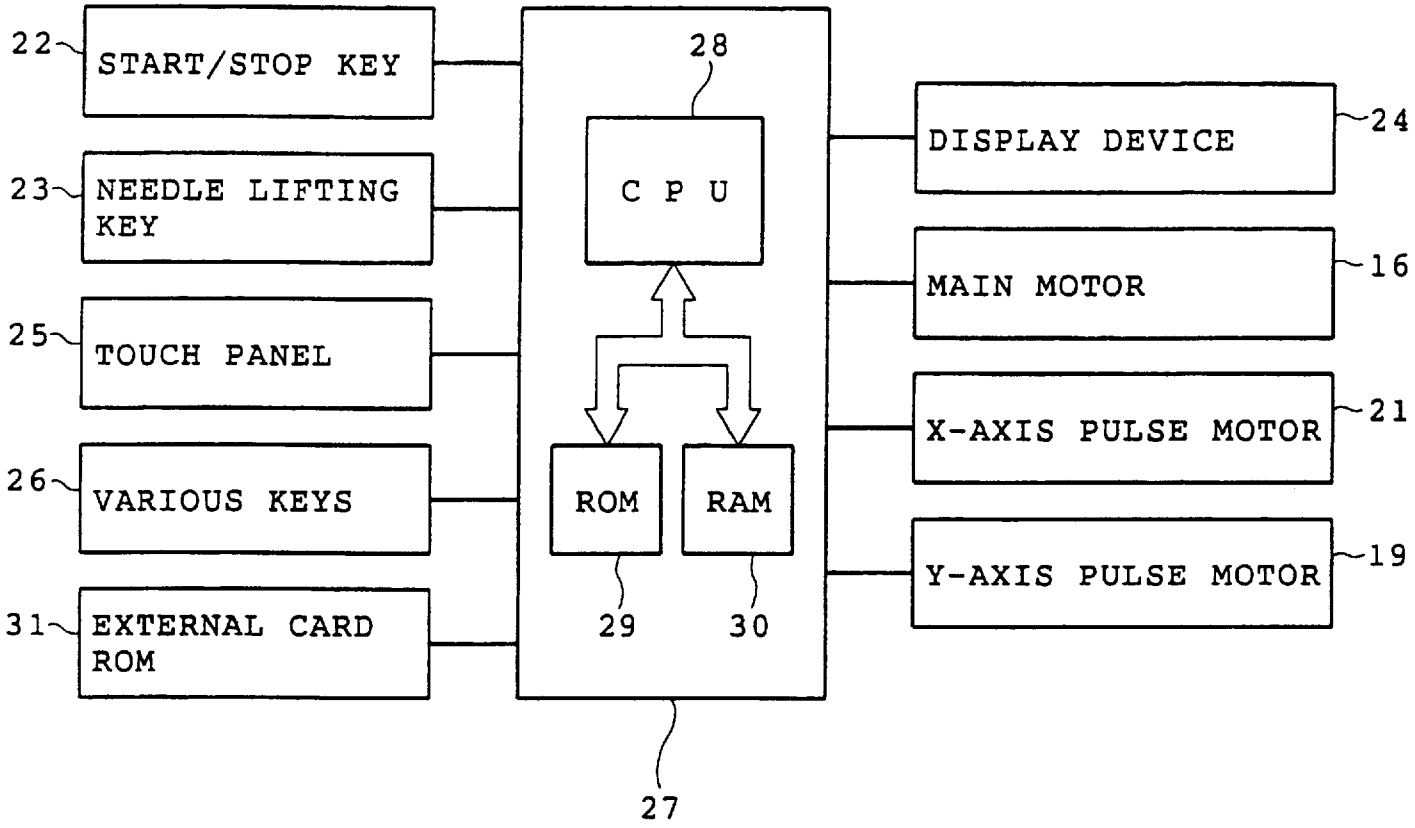
FIG. 7 is a schematic block diagram showing an electrical arrangement of the embroidery sewing machine.

A control device 27 is provided in the machine main body 11 for controlling various mechanisms of the embroidery sewing machine, as shown in FIG. 7. The control device 27 is mainly composed of a microcomputer comprising a CPU 28, ROM 29 and RAM 30. The control device 27 controls the main motor 16, X-axis and Y-axis pulse motors 21 and 19, display device 24, etc. Furthermore, signals from the start/stop key 22, needle lifting key 23, touch panel 25 and keys 26 are delivered to the control device 27.

The ROM 29 stores control programs for controlling the embroidery forming operation of the machine main body 11 and the displaying operation of the display device 24, and programs for data processing such as readout of the pattern data and origination of embroidery data. The ROM 29 further stores pattern data for determining outlines of a number of embroidery patterns regarding the embroidering. In the embodiment, an external card ROM 31 (shown only in FIG. 7) is connectable to the control device 27. The external card ROM 31 stores pattern data with respect to embroidery patterns different from those stored in the ROM 29. The pattern data stored in each of the ROMs 29 and 31 is composed of data for defining embroidery patterns. In particular, the pattern data with respect to the embroidery patterns for the multicolor sewing includes data of partial patterns obtained by dividing each embroidery pattern into one or more partial patterns, and data of embroidery thread colors (recommended colors) corresponding to the respective partial patterns. The pattern data with respect to the multicolor sewing embroidery patterns further includes display data (bit map data) necessary for displaying each pattern (partial pattern) on the display device 24.

When the embroidering is to be executed, the embroidery sewing machine of the embodiment requires sewing data indicating each stitch position, that is, amounts of movement of the workpiece cloth in the X-axis and Y-axis directions for each stitch. Calculations are performed on the pattern data (partial pattern data) to develop it into the embroidery data. The sewing data includes drive data for driving the embroidery frame 17 with respect to each stitch, a color change code provided between the drive data for each partial pattern and that for the subsequent partial patterns, and an end code provided at the end of the sewing data. The same data may be used for both pattern data and display data. Alternatively, either one set of the data may be stored and developed into the other set of data.

Based on the operations of the keys 26 on the touch panel 25 by the user, the control device 24 controls the various mechanisms of the embroidery sewing machine according to the programs so that the embroidery forming operation is executed. The control device 27 controls the display device 24 so that a number of patterns are displayed on the screen thereof in an initial mode wherein the user selects a pattern he or she wishes to embroider. Viewing the pattern selection screen, the user touches the touch panel 25 to select a desired embroidery pattern.

When an embroidery pattern for multicolor sewing is selected, the control device 27 controls, by its software arrangement, the display device 24 so that the display device displays separately the embroidery pattern display screen for displaying each partial pattern of the selected embroidery pattern and the thread color display screen for displaying the thread color corresponding to said each partial pattern, as will be described in detail later. Single color sewing data and multicolor sewing data are stored with respect to each of the pattern data and embroidery data. When the user touches one of the operation keys set on the touch panel 25, namely, a thread color key B (see FIGS. 5A–5D), the control device 27 controls the display device 24 so that its screen is switched between the embroidery pattern display screen and the thread color display screen. Accordingly, the control device 27 constitutes display control means in the present invention. The touch panel 25 constitutes display switching operation means in the invention. Furthermore, a total number of the partial patterns composing the selected embroidery pattern is also displayed on both of the embroidery pattern display screen and the thread color display screen. Additionally, the control device 27 controls the display device 24 so that an order of the partial pattern currently under sewing is also displayed on both of the embroidery pattern display screen and the thread color display screen during execution of the sewing.

The user sometimes wishes to embroider an embroidery pattern with a single color thread although the pattern should originally be used for a multicolor sewing. In view of such a case, a color change key C (see FIGS. 5A–5D) is provided on the touch panel 25 when either the embroidery pattern or thread color display screen is displayed. When the color change key C is touched, a multicolor sewing mode in which the partial patterns are embroidered with different color threads is switched to a single color sewing mode in which the embroidery pattern is embroidered with a single color thread. When the sewing mode has been switched to the single color sewing mode as described above, the control device 27 controls the display device 24 so that a pattern formed by compositing all the partial patterns is displayed on the embroidery pattern display screen and an indication that the user can freely select a thread color, or more specifically, an indication of "COLOR FREE" is displayed on the thread color display screen. Accordingly, the touch panel 25 constitutes mode switching operation means in the invention.

The operation of the above arrangement will be described with reference to FIGS. 1 to 5D. In the following description of operation, an embroidery pattern D of "panda" as shown in FIGS. 5A to 5D is selected as an embroidery to be sewn. The "panda" embroidery pattern D is directed to the multicolor sewing and divided into three partial patterns including a pattern D1 of a portion covered with white hair and eyes in the face, a pattern D2 of hind legs, and a pattern D3 of ears, fringes around eyes, forelegs, and the overall contour, as shown in FIG. 5A. Thread colors (recommended colors) for the partial patterns D1 to D3 are white, red and black respectively.

Figure 1:
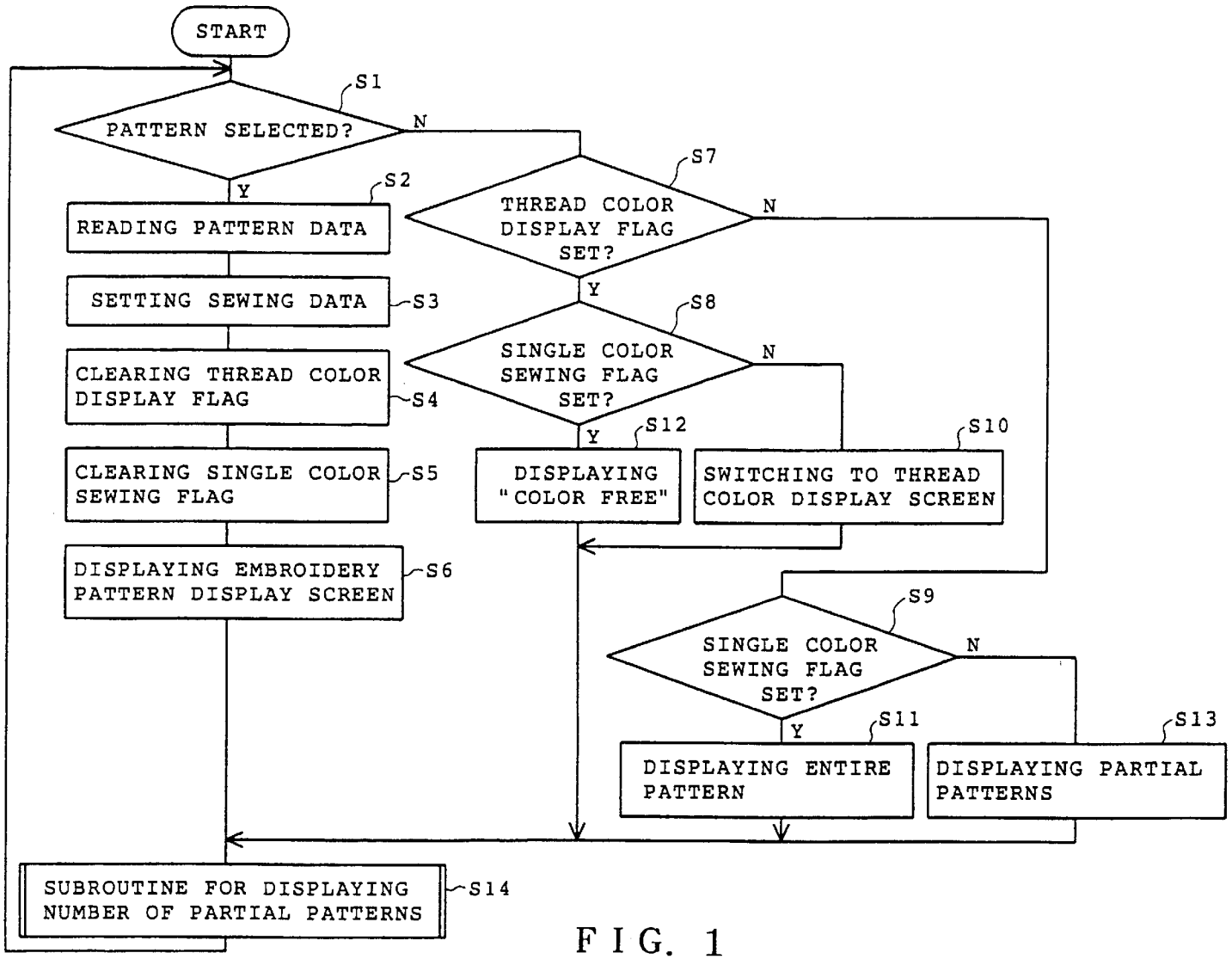
FIG. 1 is a flowchart showing the procedure for controlling a display device in the selection of an embroidery pattern, the display device being incorporated in an embroidery sewing machine of one embodiment in accordance with the present invention.

The flowchart of FIG. 1 shows control executed by the control device 27 or more specifically, a main routine for controlling the display device 24 when the user selects an embroidery pattern. When power is applied to the machine main body 11, the display device 24 displays a screen for selection of an embroidery pattern or an initial screen (not shown). Viewing the initial screen, the user selects a desired embroidery pattern or the "panda" embroidery pattern D in this case.

When the embroidery pattern selecting operation has been performed (YES at step S1), pattern data with respect to the selected embroidery pattern is read from the ROM 29 or the external card ROM 31 at step S2. Sewing data for the selected embroidery pattern is then set at step S3. A thread color flag is cleared at step S4 and a single color sewing flag is also cleared at step S5. The thread color flag shows which should be displayed, the embroidery pattern display screen or the thread color display screen, and the single sewing flag shows which should be displayed on the display device 24, the multicolor sewing mode or the single color sewing mode, as will be described later.

The embroidery pattern display screen is displayed in the multicolor sewing mode on the display device 24 at step S6. Thus, the display device 24 displays the embroidery pattern display screen in the multicolor sewing mode immediately after selection of the embroidery pattern. FIG. 5A shows the embroidery pattern display screen in the multicolor sewing mode. The various operation keys including the color change key C are set on an upper portion of the screen of FIG. 5A. Furthermore, the thread color key B is set on the right-hand end of the screen. A currently sewn partial pattern display E, which is indicative of the order of the partial pattern for which the embroidery forming operation is currently under execution, is displayed above the thread color key B. In this regard, although the embroidery forming operation has not been started, "1" is displayed as the display E. A color number display F, representative of the total number of partial patterns, is also displayed above the key B. In this case, "3" is displayed as the display F. The displays E and F are displayed together with virgule interposed therebetween. The partial patterns D1 to D3 of the embroidery pattern D are displayed on the other region of the embroidery pattern display screen in the order of sewing from the left.

Since the display device 24 is monochromatic, a portion or portions of each of the partial patterns D1 to D3 on which the thread is to be exposed are displayed in black on the screen. Four partial patterns in total can be displayed on the screen of the display device 24. When the embroidery pattern is divided into five or more partial patterns, they are displayed on two or more screens. In order that the undisplayed partial patterns may be displayed, the screen is caused to scroll so that the partial patterns on the screen are moved one by one to the left, for example. In this case, the color number display F is controlled according to the flowchart of FIG. 3 at step S14, as will be described later. Furthermore, the current partial pattern display E is controlled according to the flowchart of FIG. 4 as will be described later.

After the embroidery pattern has been selected as described above, the control device 27 usually monitors the thread color display flag at step S7 and the single color sewing flag at steps S8 and S9 to thereby judge whether the each of these flags has been set. The flags are set and cleared in an interrupt routine (key scan routine) as will be described with reference to FIG. 2 later.

When the thread color display flag is set with the single color sewing flag remaining cleared (NO at step S8), the screen of the display device 24 is switched to the thread color display screen in the multicolor sewing mode at step S10. FIG. 5B shows the thread color display screen in the multicolor sewing mode. The partial patterns D1 to D3 on the embroidery pattern display screen are switched to thread color displays G corresponding thereto respectively. The thread color displays G are in the form of characters. More specifically, the left-hand thread color display G, "WHITE," corresponds to the partial pattern D1. The middle thread color display G, "RED," corresponds to the partial pattern D2. The right-hand thread color display G, "BLACK," corresponds to the partial pattern D3. Since the partial patterns D1–D3 and the thread colors are displayed in the same order in the same rectangular frames on the screen, the relationship therebetween can readily be confirmed. In other words, the thread color displays on the thread color display screen are displayed so as to occupy the same locations as the partial patterns on the embroidery pattern display screen respectively. The display mode of the thread color key B is reversed when the embroidery pattern display screen is switched to the thread color display screen.

When the single color sewing flag is set with the thread color display flag remaining cleared (YES at step S9), the sewing mode is switched from the multicolor sewing mode to the single color sewing mode. The display device 24 is switched to the embroidery pattern display screen in the single color sewing mode to thereby display the entire embroidery pattern D composed of all the partial patterns at step S11. FIG. 5C shows the embroidery pattern D displayed on the screen of the display device 24. The display mode of the color change key C is reversed when the display device 24 is switched to the embroidery pattern display screen in the single color sewing mode.

Furthermore, the display device 24 is switched to the thread color display screen in the single color sewing mode at step S12 when the thread color display flag is set with the single color sewing flag remaining set or in the single color sewing mode (YES at step S8). The display device 24 displays the display H, "COLOR FREE" as shown in FIG. 5D. When neither of the flags are set (NO at step S9), the display device 24 continuously displays the embroidery pattern display screen in the multicolor sewing mode as shown in FIG. 5A at step S13.

Figure 2:
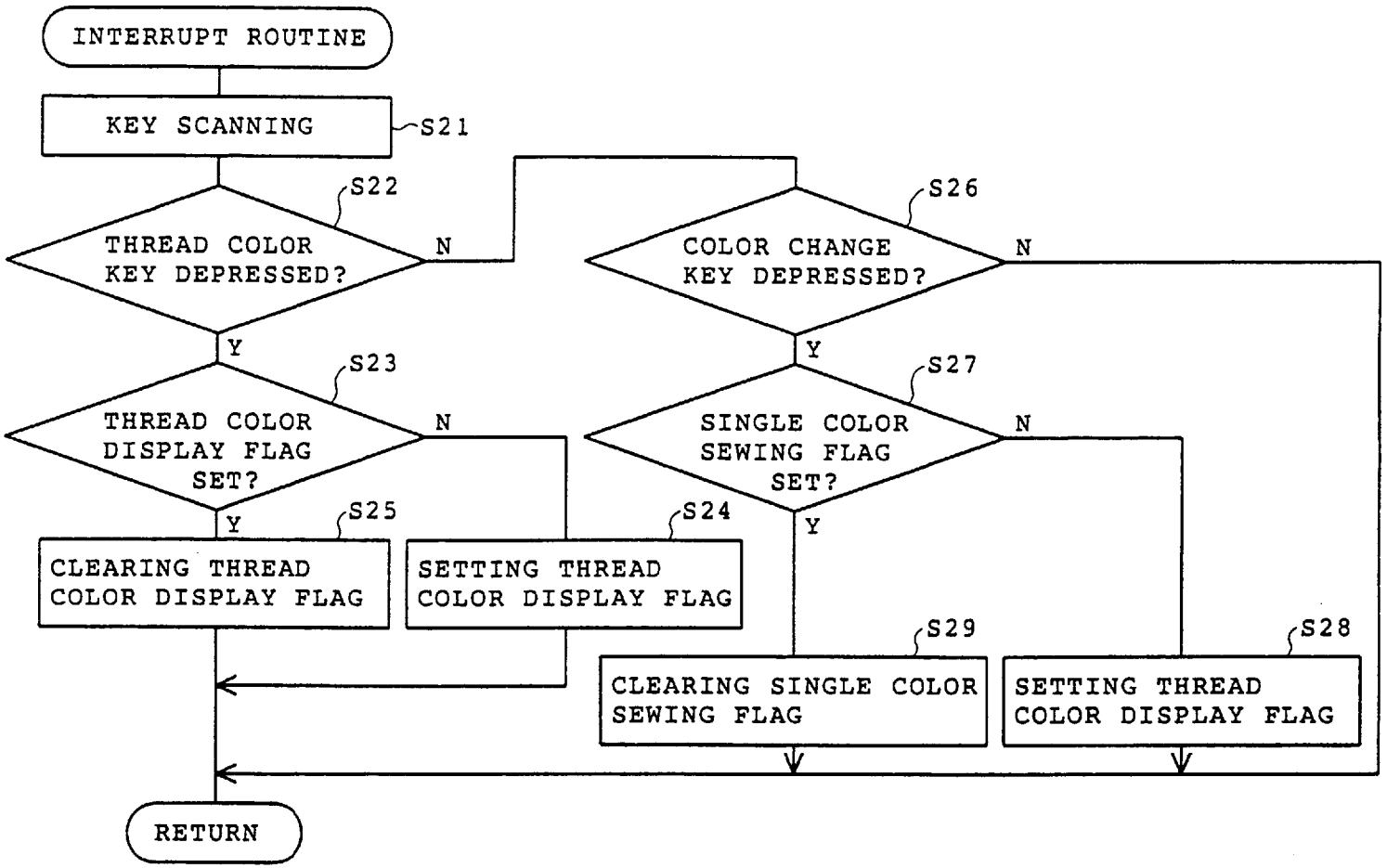
FIG. 2 is a flowchart showing the procedure of an interrupt routine for setting a thread color display flag and a single color sewing flag.

FIG. 2 shows the procedure of interrupt routine in which the thread color display flag and the single color sewing flag are set by the user's key operation. The control device 27 usually monitors the thread color display flag and the single color sewing flag during execution of the main routine shown in FIG. 1. When the thread color key B of the touch panel 25 is touched (YES at step S21), the control device 27 judges the current state of the thread color display flag at step S23. The thread color display flag is set at step S24 when cleared (NO at step S23). On the other hand, the thread color display flag is cleared at step S25 when set (YES at step S23). Furthermore, the control device 27 judges the current state of the single color sewing flag at step S27 when the color change key C is touched (YES at step S26). The single color sewing flag is set at step S28 when cleared (NO at step S27). On the other hand, the single color sewing flag is cleared at step S29 when set (YES at step S27).

Thus, as shown by arrows in FIGS. 5A–5D, the display device 24 is switched between the embroidery pattern display screen and the thread color display screen every time the user touches the thread color key B set on the touch panel 25 either in the multicolor sewing mode or in the single color sewing mode. Furthermore, the display device 24 is switched between the multicolor sewing mode and the single color sewing mode every time the user touches the color change key C in the case where either the embroidery pattern display screen or the thread color display screen is displayed.

Figure 3:
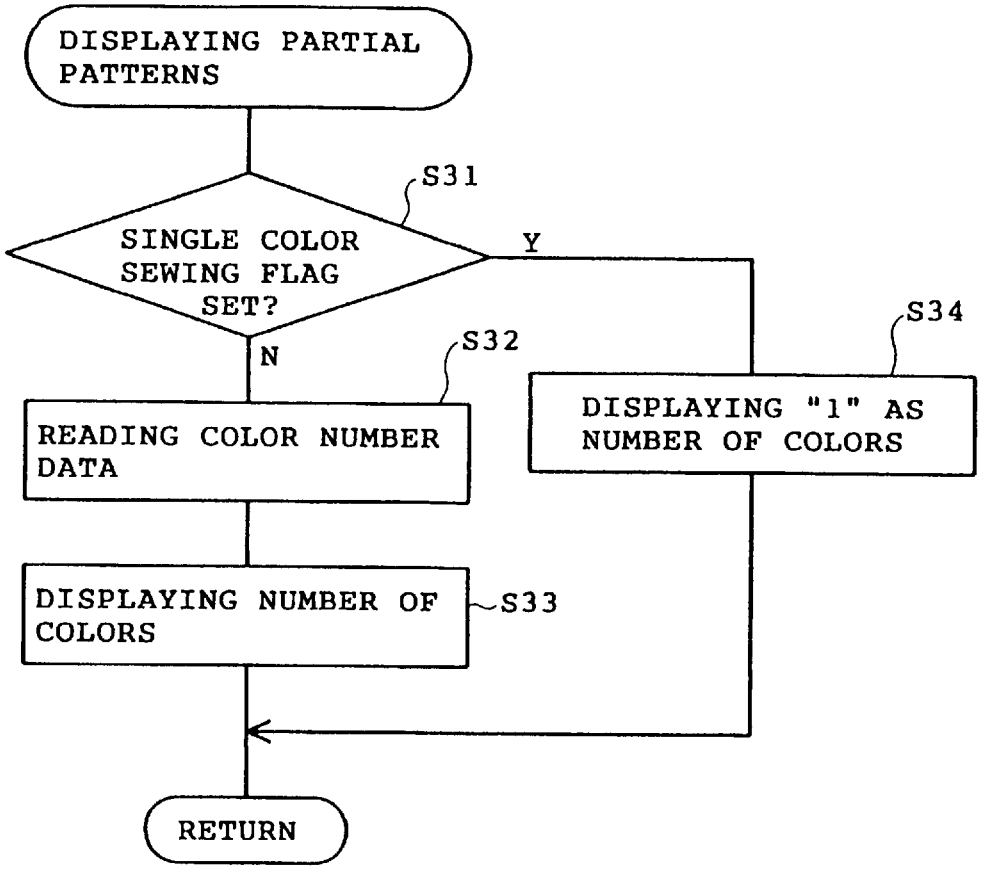
FIG. 3 is a flowchart showing the procedure of a subroutine for displaying a total number of partial patterns.

FIG. 3 shows the control contents of the subroutine for displaying the number of the partial patterns executed at step S14 in the main routine of FIG. 1. First, the control device 27 judges whether the single color sewing flag has been set at step S31. Color number data is read from the embroidery data at step S32 when the single color sewing flag is not set or when the display device 24 is in the multicolor sewing mode (NO at step S31). The number of the colors, "3" in the example of FIGS. 5A and 5B, is displayed as the color number display F on the screen at step S33. On the other hand, when the number of the colors, "1" in the example of FIGS. 5C and 5D, is displayed as the color number display F at step S34 when the single color sewing flag is set or when the display device 24 is in the single color sewing mode (YES at step S31).

Figure 4:
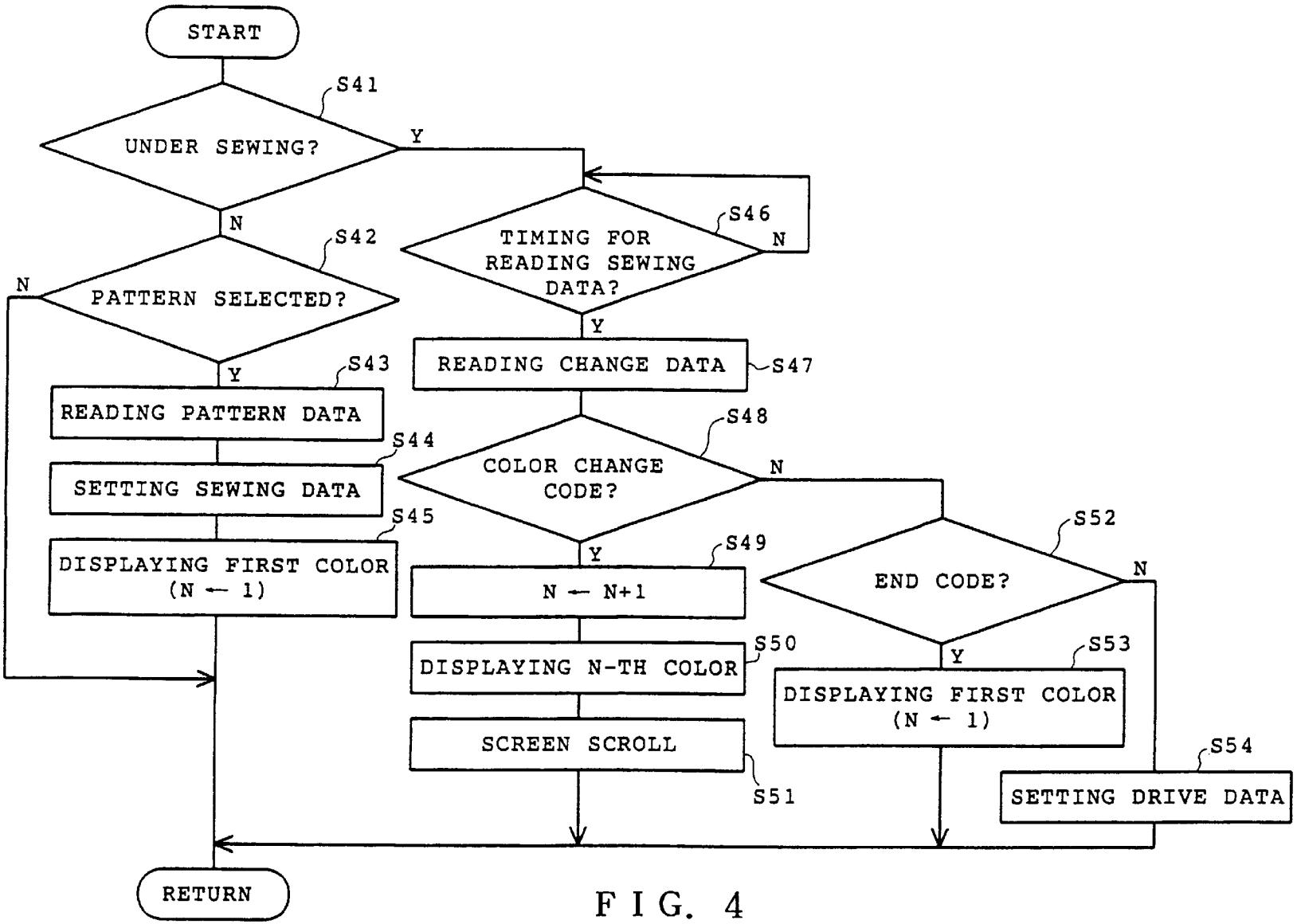
FIG. 4 is a flowchart showing the procedure for displaying a currently sewn partial pattern.

The flowchart of FIG. 4 shows the control procedure for displaying the current partial pattern E. The control device 27 judges whether the sewing operation is being executed at step S41. When the sewing operation is not under execution (NO at step S41), the control device 27 advances to step S42 to judge whether an embroidery pattern is being selected or whether the sewing operation is to be started. When the embroidery pattern is being selected or the sewing pattern is to be started (YES at step S42), the embroidery pattern data is read out at step S43 and the sewing data for the read embroidery pattern is set at step S44. The numeral, "1," is set for variable N indicative of the order of the current partial pattern and displayed on the screen of the display device 24 as the current partial pattern display E at step S45.

When the user instructs the start of the embroidery forming operation upon completion of the embroidery selection, the control device 27 reads out the sewing data one by one at intervals of predetermined sampling periods with the progress of the embroidery forming operation to execute the embroidery forming operation at steps S46 and S47. The control device 27 judges whether the read sewing data is a color change code at step S48. When the sewing data is a color change code (YES at step S48), the variable N is incremented by one at step S49 and the numeral indicative of the N-th color is displayed as the current partial pattern display E on the screen of the display device 24 at step S50. In this case, the screen of the display device 24 is scrolled so that the partial patterns D1–D3 or the thread color displays G are moved leftward, although this is not shown in detail in the drawings. Consequently, the partial pattern for which the embroidery forming operation is being performed or is to be started is displayed on the left-hand end of the screen at step S51. Thus, the screen of the display device 24 on which the partial patterns D1–D3 or the thread color displays G are displayed is automatically scrolled according to the progress of the embroidery forming operation or every time the embroidery forming operation is completed for each of the partial patterns D1–D3.

Viewing the thread color displays G on the screen, the user sets each of the threads of the designated colors in the machine main body 11 although this is not described in detail. Furthermore, when the sewing data is a color change code as described above, the embroidery forming operation is interrupted and the display device 24 displays an indication urging the user to exchange the embroidery thread. The user then sets the embroidery thread of the subsequent designated color and instructs restart of the embroidery forming operation so that the embroidery forming operation is executed for the subsequent partial pattern.

When the read sewing data is an end code (YES at step S52), the numeral "1" is set for the variable N so that the current partial pattern display E is returned to "1" at step S53. When the read sewing data is neither the color change code nor the end code or is the drive data (NO at step S52), the drive data is set so that the embroidery forming operation for one stitch is executed at step S54.

Figure 8:
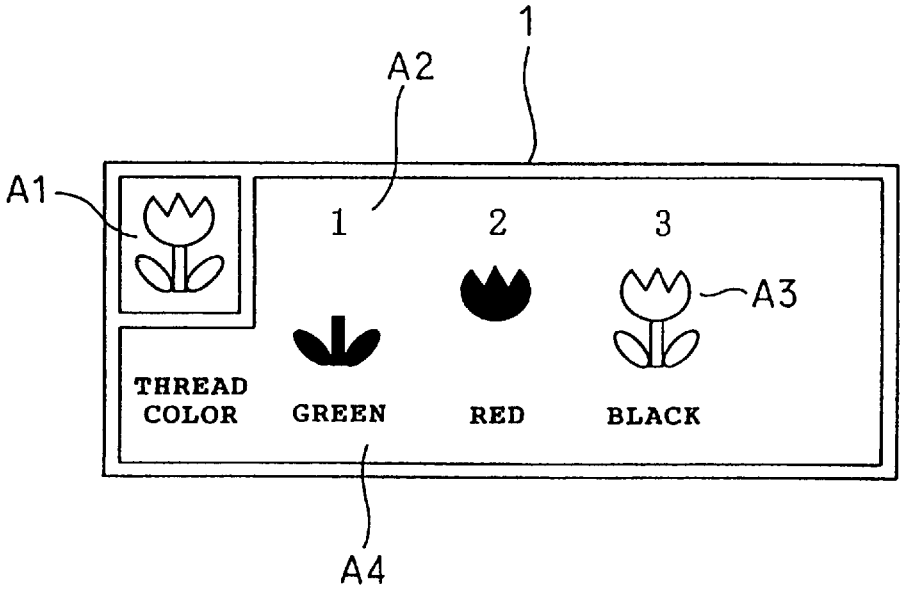
F I G. 8 PRIOR ART
FIG. 8 illustrates a screen of a display device incorporated in a conventional embroidery sewing machine.

According to the above-described embodiment, the display device 24 separately displays the embroidery pattern display screen for displaying the partial patterns and the thread color display screen for displaying the thread colors corresponding to the respective partial patterns. The display device 24 is switched between these screens when the user touches the thread color key B of the touch panel 25 set on the screen. Accordingly, a larger region of the screen used for each displayed information can be obtained in the embodiment as compared with the conventional arrangement (see FIG. 8) in which both of the partial patterns A3 and the colors of the embroidery threads A4 are displayed on a single screen of the LCD 1. Consequently, the partial patterns D1–D3 of the embroidery pattern D and the thread color displays G corresponding to the respective partial patterns D1–D3 can be displayed for the user to be clearly recognized, and the display device 24 can be prevented from being increased in its size. Furthermore, the display device 24 comprises a small-sized monochrome LCD, and moreover, the touch panel 25 is provided on the display device 24. Accordingly, since the display device 24 can be rendered less expensive in cost and small in size, the machine main body 11 can be prevented from being large-sized and the operability and space saving of the embroidery sewing machine can be improved. Particularly in the above-described embodiment, the current partial pattern display E and the color number display F are also displayed on the screen of the display device 24. Consequently, information useful for the user can also be displayed on the display device 24. Furthermore, information displayed on the display device 24 can effectively used during execution of the embroidery forming operation. Consequently, the usability of the embroidery sewing machine can be improved.

The thread color data contained in the pattern data represents colors recommended as desired colors by the supplier. What colors of threads should actually be used is of user's own volition. Furthermore, an embroidery pattern for the multicolor sewing can conventionally be formed with a single color thread. In this arrangement, a thread of one color needs to be changed to one of another color either by the sewing machine itself or by the user when sewing for one partial pattern is completed and sewing for a subsequent partial pattern is to be started in the multicolor sewing mode.

In the above-described embodiment, however, when the color change key C is touched, the sewing mode can be switched between the multicolor sewing mode in which the partial patterns are embroidered with threads of different colors and the single color sewing mode in which the embroidery pattern is embroidered with a thread of a single color. Thus, the multicolor sewing mode can readily be switched to the single color sewing mode when the user wishes the embroidery pattern originally for the multicolor sewing to be embroidered with a single color thread. Consequently, since a thread changing operation of the machine and a thread changing work by the user are eliminated, the embroidery forming operation can efficiently be performed and the usability of the machine can further be improved. When the sewing mode has been switched to the single color sewing mode, the display device 24 is controlled to display, on the embroidery pattern display screen, a pattern formed by compositing all the partial patterns, and the indication H, "COLOR FREE," is displayed on the thread color display screen. Accordingly, since a displaying operation suitable for the single color sewing is performed, misunderstandings and bewilderment of the user can be prevented.

The entire inside of the pattern would be displayed in black if the partial patterns D1 to D3 corresponding to the three colors were simply superimposed together. As a result, it would be impossible to recognize that the pattern represents panda. In view of this, the displayed pattern D in which the face portion is void is formed by compositing the partial patterns on the basis of the pattern data for the single color sewing in the above-described embodiment. However, a pattern completely agreeing with one formed by combining the partial patterns together may be displayed instead of the above-mentioned pattern D when the partial patterns have different degrees of light and shade or a color display device is employed for the purpose of pattern recognition on the screen.

The embroidery forming operation is interrupted when the touch panel 25 or more specifically, the thread color key B, the color change key C, etc. thereof is touched during execution of the embroidery forming operation. A re-starting operation is necessary to continue the interrupted embroidery forming operation. On the other hand, the embroidery forming operation may be continued without interrupt even when the touch panel 25 is touched during execution of the embroidery forming operation. Since the re-starting operation is not required in this arrangement, the usability of the embroidery sewing machine can further be improved.

The screen of the display device 24 displaying the partial patterns D1–D3 or the thread color displays G automatically scrolls in the foregoing embodiment. However, a scrolling key may be provided so that the screen displaying the partial patterns D1–D3 or the thread color displays G scrolls when the scrolling key is operated, instead. The scrolling key may be included in the touch panel 25 or added to the various keys 26 provided on the arm 13. Additionally, the thread color key B and color change key C may be added to the keys 26 instead of being provided on the touch panel 25.

In the foregoing embodiment, the CPU 28 (namely, the control device 27) is operated on the basis of the programs stored in the ROM 29 so that the display control means is accomplished. However, electronic circuits (display control circuit) for accomplishing the functions of the display control means may be composed of hardware such as gate circuits and provided in the embroidery sewing machine or the control device thereof, instead.

Although the ROM 29 stores the programs to accomplish the display control means in the foregoing embodiment, the programs may be stored in an external card ROM so that the CPU 28 (namely, the control device 27) is operated on the basis of the programs stored in the external card ROM, instead. Furthermore, an electrically erasable programmable read-only memory (EEPROM) may be provided in the control device 27. In this case, the programs stored in the external card ROM are transferred to the EEPROM and thereafter, the CPU 28 (namely, the control device 27) is operated on the basis of the programs stored in the EEPROM. Furthermore, the embroidery sewing machine may be provided with a hard disk system and a floppy disk drive so that the programs are stored in the hard disk system. In this case, the programs are preferably stored in a floppy disk, and the floppy disk is preferably attached to the floppy disk drive so that the programs are installed on the hard disk system of the embroidery sewing machine. Furthermore, the programs may be stored in a CD-ROM and the embroidery sewing machine may be provided with a CD-ROM drive so that the programs are installed through the CD-ROM on the embroidery sewing machine. Additionally, a recording medium for storing the programs should not be limited to the external card ROM, floppy disk and CD-ROM. Other recording media may be used for the purpose.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

I claim:

1. An embroidery sewing machine comprising:

an embroidery forming apparatus for forming an embroidery on a workpiece cloth based on pattern data including data of different partial patterns obtained by dividing an embroidery pattern into one or more different partial patterns and data of thread colors representing colors of embroidery threads corresponding to the respective partial patterns;

a machine main body;

a display device provided on the machine main body;

display control means for controlling the display device so that the display device separately displays an embroidery pattern display screen for displaying each partial pattern and a thread color display screen for displaying a thread color corresponding to each partial pattern, based on the pattern data; and display switching operation means operated for switching the display on the display device between the embroidery pattern display screen and the thread color display screen.

2. An embroidery sewing machine according to claim 1, wherein the display device comprises a monochrome liquid crystal display (LCD).

3. An embroidery sewing machine according to claim 1, wherein the display control means controls the display device so that a total number of the partial patterns is displayed on each of the embroidery pattern display and thread color display screens.

4. An embroidery sewing machine according to claim 2, wherein the display control means controls the display device so that a total number of the partial patterns is displayed on each of the embroidery pattern display and thread color display screens.

5. An embroidery sewing machine according to claim 1, wherein the display control means controls the display device so that the display device displays an order of the currently sewn partial pattern in a sequence of the partial patterns during execution of an embroidery forming operation.

6. An embroidery sewing machine according to claim 1, further comprising mode switching operation means operated for switching a sewing mode between a multicolor sewing mode in which the partial patterns are embroidered by threads of different colors respectively and a single color sewing mode in which all the partial patterns are embroidered by a thread of a single color.

7. An embroidery sewing machine according to claim 6, wherein when the sewing mode has been switched to the single color sewing mode, the display control means controls the display device so that the display device displays, on the embroidery pattern display screen, a pattern formed by compositing all the partial patterns, and so that the display device displays, on the thread color display screen, to an effect that a user can freely select a thread color.

8. An embroidery sewing machine according to claim 1, wherein the display switching operation means comprises a touch panel provided on a screen of the display device.

9. An embroidery sewing machine according to claim 6, wherein the mode switching operation means comprises a touch panel provided on a screen of the display device.

10. An embroidery sewing machine according to claim 1, wherein the display control means controls the display device so that a position on the embroidery display screen at which position each partial pattern is displayed is substantially the same as a position on the thread color display screen at which position each thread color corresponding to each partial pattern is displayed.

11. An embroidery sewing machine according to claim 1, wherein the screen of the display device can be switched when the display switching operation means is operated even after the embroidery forming apparatus has started the embroidery forming operation.

12. An embroidery sewing machine according to claim 11, wherein the embroidery forming operation of the embroidery forming apparatus is interrupted when the screen of the display device has been switched upon operation of the display switching operation means during execution of the embroidery forming operation.

13. An embroidery sewing machine according to claim 11, wherein the embroidery forming operation of the embroidery forming apparatus is continued when the screen of the display device has been switched upon operation of the display switching operation means during execution of the embroidery forming operation.

14. An embroidery sewing machine according to claim 1, wherein the display control means controls the display device so that the embroidery pattern display screen and the thread color display screen are caused to scroll.

15. An embroidery sewing machine according to claim 14, wherein the display control means controls the display device so that the embroidery pattern display screen and the thread color display screen are caused to automatically scroll, whereby the partial pattern and the thread color displayed on the respective screens go out of the respective screens when the embroidery forming operation for said partial pattern is completed.

16. An embroidery sewing machine comprising:

an embroidery forming apparatus for forming an embroidery on a workpiece cloth based on pattern data including data of different partial patterns obtained by dividing an embroidery pattern into one or more different partial patterns and data of thread colors representing colors of embroidery threads corresponding to the respective partial patterns;

a machine main body;

a display device provided on the machine main body;

a display control circuit for controlling the display device so that the display device separately displays an embroidery pattern display screen for displaying each partial pattern and a thread color display screen for displaying a thread color corresponding to each partial pattern, based on the pattern data; and a display switch operated for switching the display on the display device between the embroidery pattern display screen and the thread color display screen.

17. A storage medium for storing a program for operating an embroidery sewing machine, the program accomplishing the functions of display control means for controlling a display device so that the display device separately displays an embroidery pattern display screen for displaying one or more partial patterns and a thread color display screen for displaying a thread color corresponding to each partial pattern, based on a pattern data.

* * * * *